United States Patent [19]

Swinney

[11] 4,413,555

[45] Nov. 8, 1983

[54] PRESS FOR THE COMPRESSION OF LOADS

[75] Inventor: Dennis P. Swinney, Morpeth, England

[73] Assignees: Swinney Engineering Limited, Northumberland, England; Lanso Products Limited, Ramsey, Isle of Man

[21] Appl. No.: 274,806

[22] Filed: Jun. 18, 1981

[30] Foreign Application Priority Data

Jun. 19, 1980 [GB] United Kingdom ..... 8020008

[51] Int. Cl.[3] ..... B30B 15/04

[52] U.S. Cl. ..... 100/214; 100/3; 100/278; 100/295

[58] Field of Search ..... 100/214, 245, 258 A, 100/258 R, 295, 240, 278, 3

[56] References Cited

U.S. PATENT DOCUMENTS

| | | | |
|---|---|---|---|
| 782,862 | 2/1905 | Lucas | 100/214 X |
| 3,024,720 | 3/1962 | Welsh | 100/245 X |
| 3,154,009 | 10/1964 | Dewyer | 100/214 |
| 3,280,727 | 10/1966 | Jonas | 100/245 X |
| 3,568,498 | 3/1971 | Pearson | 100/214 X |
| 3,631,795 | 1/1972 | Maxwell | 100/240 |
| 3,937,140 | 2/1976 | Swanson | 100/245 |
| 4,041,856 | 8/1977 | Fox | 100/245 X |

FOREIGN PATENT DOCUMENTS

| | | |
|---|---|---|
| 253735 | 11/1912 | Fed. Rep. of Germany . |
| 1011612 | 7/1957 | Fed. Rep. of Germany . |
| 1270257 | 7/1961 | France . |
| 1458488 | 10/1966 | France . |
| 773068 | 4/1957 | United Kingdom . |
| 1185908 | 3/1970 | United Kingdom . |

*Primary Examiner*—Billy J. Wilhite

*Attorney, Agent, or Firm*—Schuyler, Banner, Birch, McKie & Beckett

[57] ABSTRACT

A press has a framework (1) which supports a pressure plate (3). The pressure plate is attached to a fluid operated ram assembly (4) by means of gimbals (20) so that the pressure plate (3) may adopt different angular attitudes relative to the load being compressed. In order to prevent the ram assembly (4) being subjected to stress the ram assembly (4) is mounted on the framework (1) by means of gimbals (18). The freedom of movement of the pressure plate (3) laterally is restrained by opposed pins (26) which engage loosely in slots (27) on the frame and stops (28) on the opposed pins. The press may be used to compress a palletized load, such as cardboard box blanks, prior to banding.

5 Claims, 11 Drawing Figures

PRESS FOR THE COMPRESSION OF LOADS

This invention relates to a press for the compression of loads.

Presses for the compression of loads are well known. For example U.K. Patent No. 543717 discloses a baling press for compacting material in a press box in which a compaction platen is axially movable by means of interengagement of gearing with two spaced non-rotatable screws fixed to the platen.

In another baling press disclosed in U.K. Patent Specification No. 1089963 a similar arrangement is disclosed except that the compaction platen is axially movable by means of a double-acting pneumatic cylinder the ram of which is secured to the centre of the platen: the axial movement being guided by lateral guide rods which are attached to the compaction platen one on each side of the ram.

According to the present invention there is provided a press for the compression of a load comprising a pressure member movable relative to the load for compressing the load, the pressure member, during compression, being free to adopt different angular positions relative to the load so as to accommodate any irregularity in the shape of the load.

Preferably the pressure member is movable relative to the load by means of a ram assembly, the pressure member being pivotally attached to the ram assembly.

In order to prevent any sideways stress upon the ram assembly, the ram assembly may be pivotally connected to a supporting frame of the press.

In an alternative embodiment of the invention the pressure member is pulled towards the load by means of a ram assembly acting upon a cord element which engages the pressure member, the pressure member being moved away from the load by a further cord element connected to the pressure member and which, in addition, permits the pressure member, during compression, to adopt different angular positions relative to the load.

Preferably the pressure member includes means restraining lateral displacement thereof, such means comprising two pins, one projecting from each of two opposed sides of the pressure member, which engage loosely in respective slots in the frame, and stops on the pins.

In accordance with another aspect of the invention there is provided a press for the compression of a load comprising an upstanding frame defining a compression area and supporting a pressure plate, means for moving the pressure plate upwardly and downwardly so as to compress a load located within the compression area, the pressure plate being pivotably attached to said means so that a degree of rotational movement of the pressure plate about a substantial horizontal axis is possible thereby accommodating irregularity in the shape of the load.

The invention will now be described by way of example with reference to the accompanying drawings in which.

Figure 2:
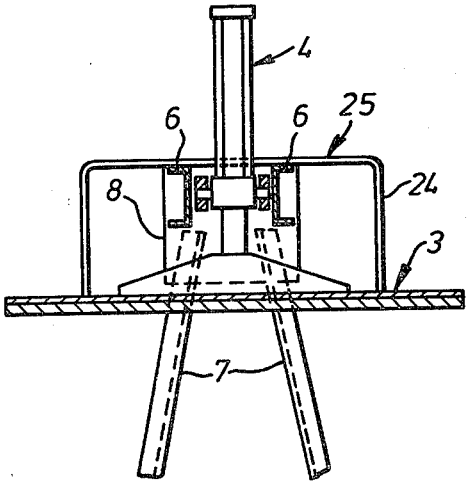
FIG. 2 is a sectional side elevation on II—II in FIG. 1.
Figure 2B:
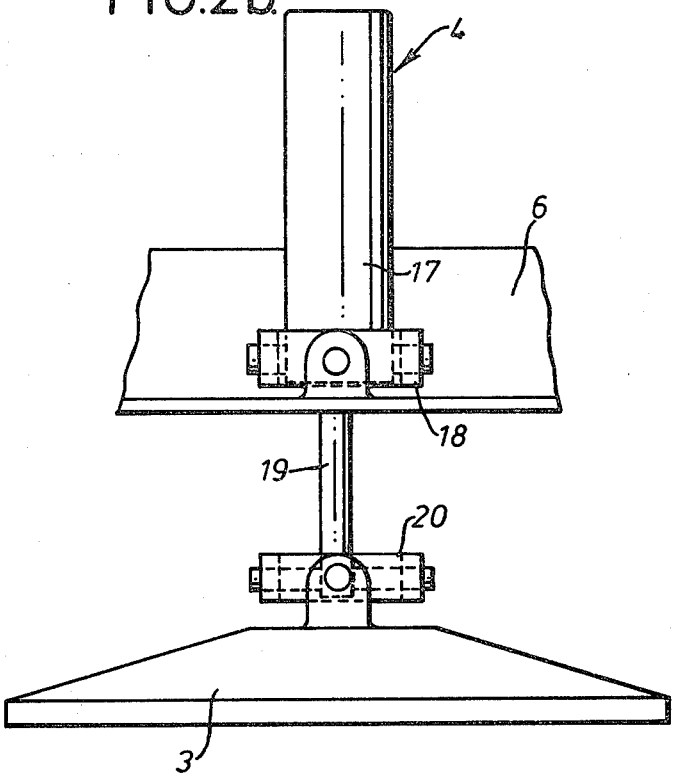
Figure 2A:
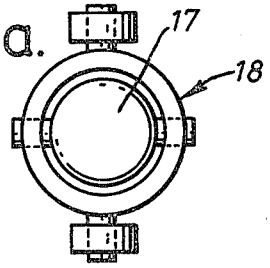
Figure 3:
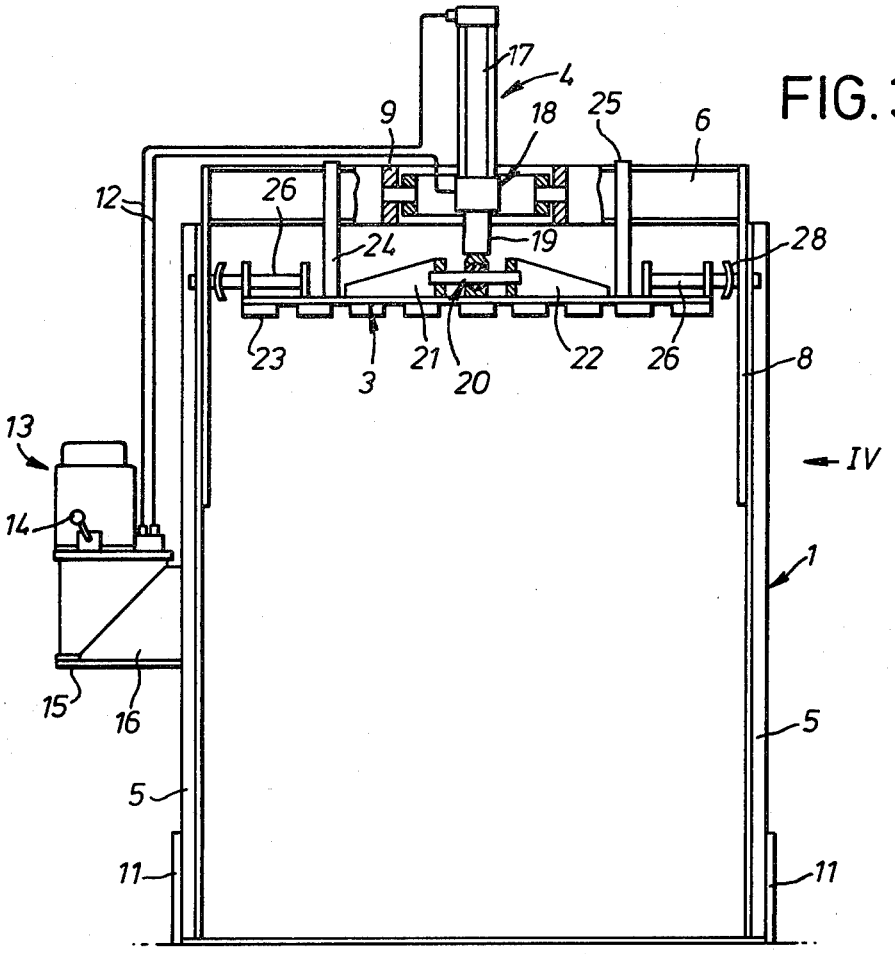
Figure 4:
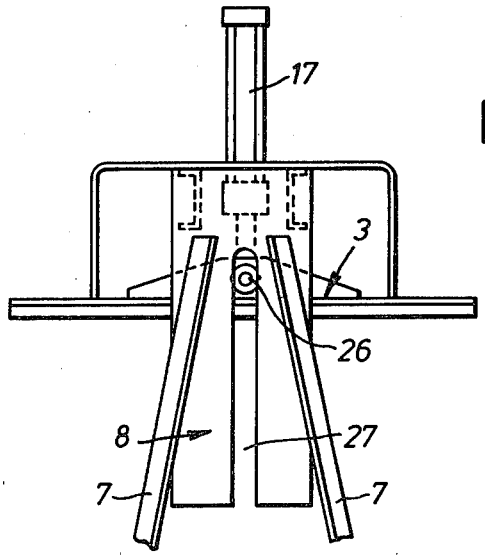
Figure 5:
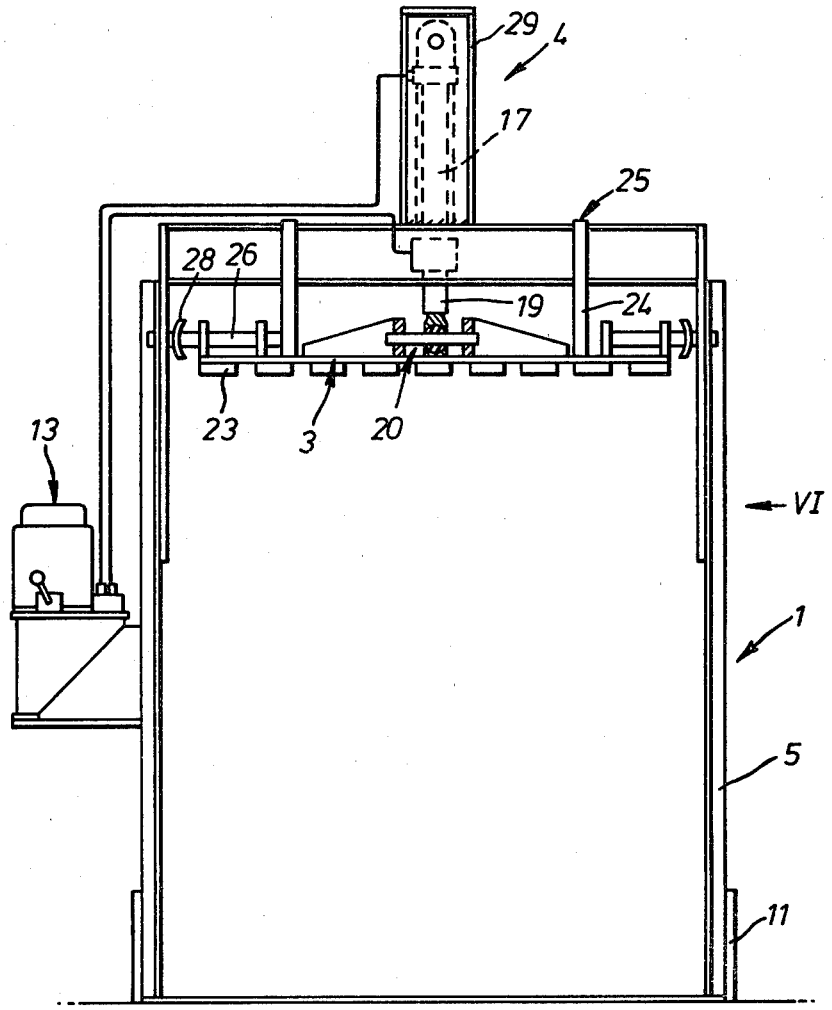
Figure 5A:
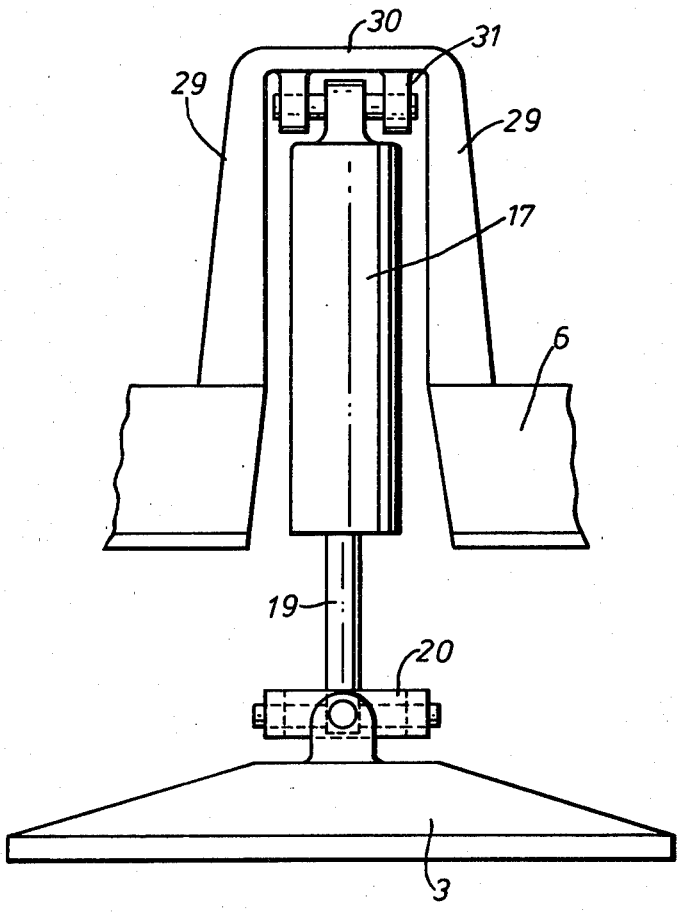
Figure 6:
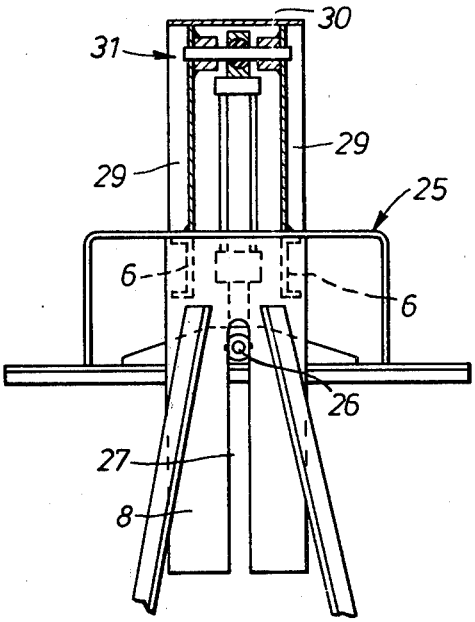
Figure 8:
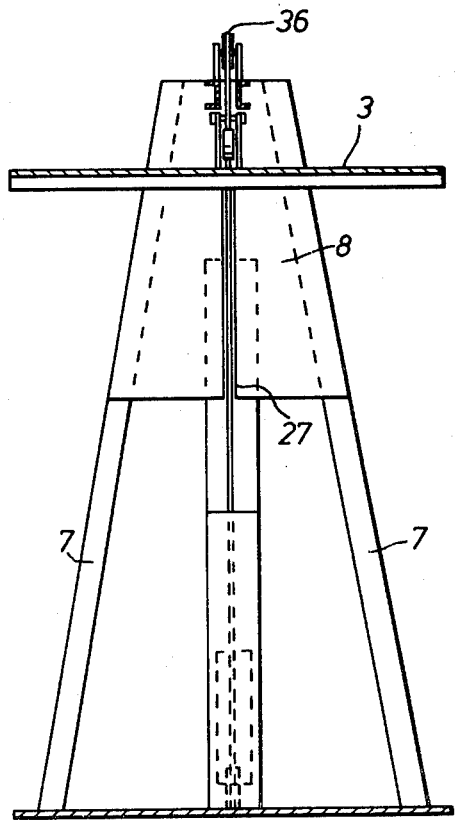
Figure 7:
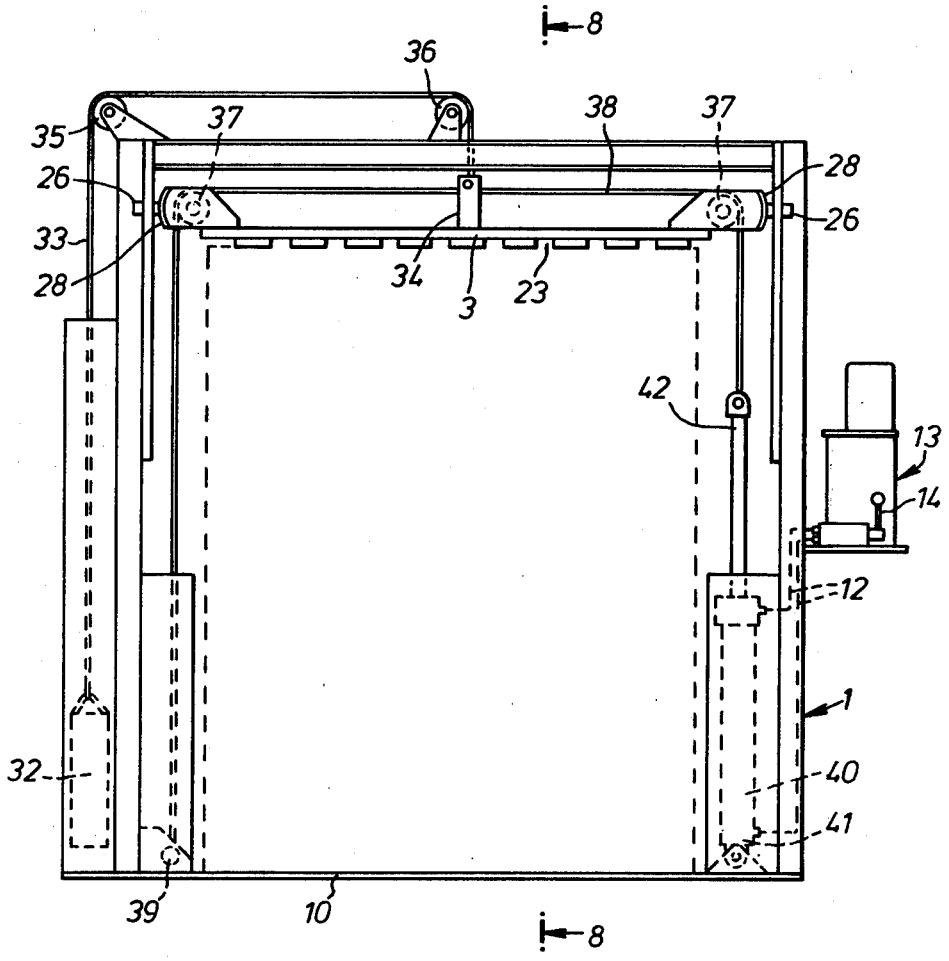

FIG. 2*a* is a diagrammatic plan view of a typical gimbal mounting suitable for the hydraulic cylinder of the first embodiment;

FIG. 2*b* is a diagrammatic side elevation showing the cylinder mounting arrangement of the first embodiment using gimbals;

FIG. 3 is a front elevation of a second embodiment of a press in accordance with the present invention partially broken away;

FIG. 4 is a side elevation in the direction of arrow IV in FIG. 3 partially broken away;

FIG. 5 is a front elevation of a third embodiment of a press in accordance with the present invention;

FIG. 5*a* is a diagrammatic side elevation showing the cylinder attachment of the third embodiment but with the pressure plate mounted by gimbals instead of a spherical bearing;

FIG. 6 is a side elevation in the direction of arrow VI in FIG. 5 partially broken away;

FIG. 7 is a front elevation of a fourth embodiment of a press in accordance with the invention; and FIG. 8 is a section on 8—8 in FIG. 7.

In the drawings, for simplicity, like parts have the same reference numerals in each embodiment.

Figure 1:
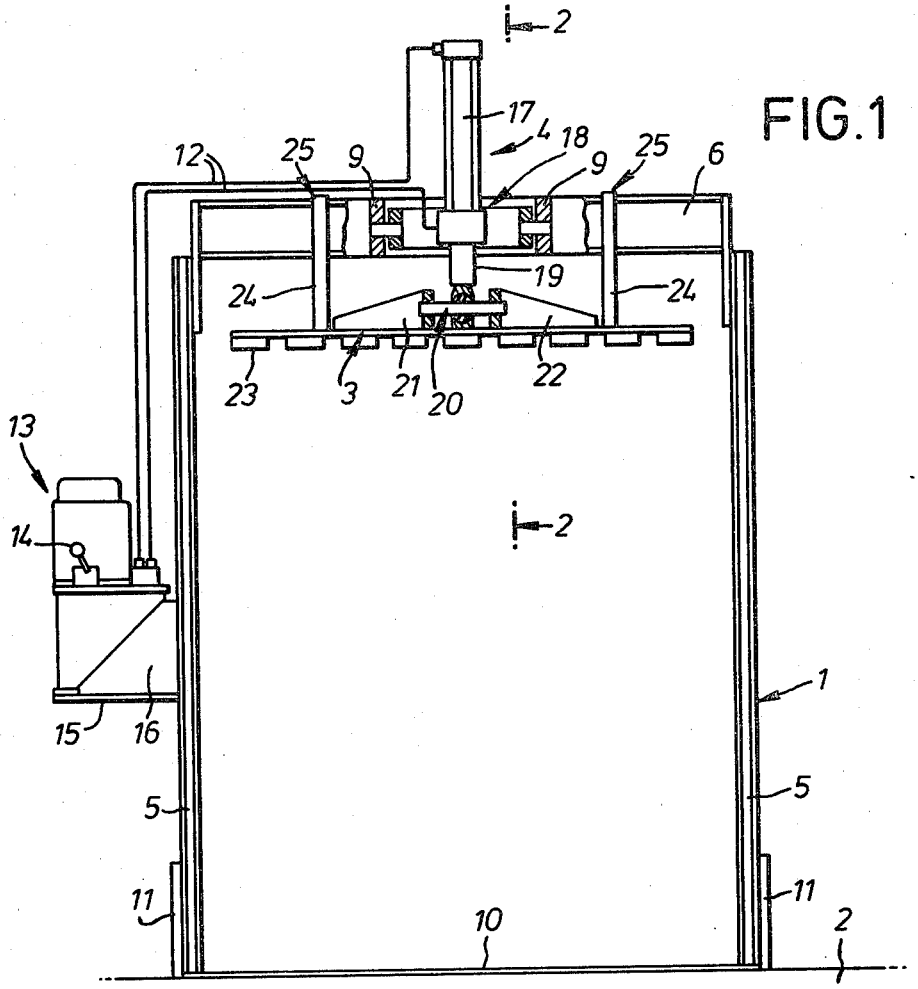
FIG. 1 is a front elevation of a first embodiment of a press in accordance with the present invention partially broken away.

Referring to FIGS. 1 and 2, the press of the first embodiment comprises a framework 1 which rests on the ground 2 and which supports a pressure plate 3. The pressure plate 3 is attached to a fluid operated ram assembly 4 so that the pressure plate 3 can be moved vertically upwards and downwards to compress a load located below.

The framework comprises a pair of spaced vertical frame members 5 which are attached at their upper ends to and support a pair of spaced interconnected horizontal members 6. Each of the vertical frame members 5 is made up of two rigid struts 7 inclined to one another so that the members 6 are adequately supported. The pairs of struts 7 are secured together at their upper ends by respective plates 8 each of which is attached to the adjacent ends of the members 6. In addition, the members 6 are interconnected by two cross members 9, one disposed on each side of the ram assembly 4. A base plate 10, which is located on the ground 2 below the pressure plate 3, is attached to the lower ends of the struts 7 of the frame members 5 by brackets 11.

Disposed at approximately the centre of the horizontal members 6 is the ram assembly 4, which is hydraulic and disposed vertically so that it can act downwardly between the members 6 to which the ram assembly 4 is attached via cross members 9. Hydraulic feed lines 12 are attached to the ram 4 and extend down one of the frame members 5 to a hydraulic pump, tank and motor arrangement 13 whereby the ram 4 is operated via a control lever 14. The arrangement 13 is located on a platform 15 attached to the said one frame member 5 by means of brackets 16.

The ram assembly 4 comprises a trunnion mounted hydraulic cylinder 17, the bottom of which is attached to the cross members 9 by means of gimbals 18 shown diagrammatically in FIG. 2*a* and a piston rod 19 the free end of which is attached to the pressure plate 3 by means of a spherical bearing 20 or gimbals (see FIG. 2*b*). The pressure plate 3 is provided with a pair of spaced brackets 21 and 22 on its upper side to which the gimbals 20 are attached and a plurality of spaced slots 23 on its lower side. The pressure plate 3 normally adopts a horizontal attitude but is free to move in all directions, the gimbals 18 and 20 ensuring that there is never a sideways bending stress imparted to the piston rod 19 of the hydraulic ram assembly 4.

Operation of the ram assembly 4 causes the piston rod 19 to be projected downwardly and thereby the pressure plate 3 to be lowered. The ram assembly 4 is of a type which enables the maximum travel of the pressure plate 3 to be varied and adjustments can also be made by varying the hydraulic pressure so that the applied load exerted by the pressure plate 3 can be controlled.

The gimbals 18 and 20 enable the attitude of the pressure plate 3 to vary so that loads of various shapes can be accommodated. Retraction of the piston rod 19 into the ram assembly 4 causes the pressure plate 3 to be moved to its uppermost position in which it engages the depending arms 24 of a pair of substantially U-shaped members 25 located on members 6. The members 25 are so spaced and are of such a size that, in the uppermost position of the pressure plate 3, the ends of the arms 24 locate at the outer sides of the brackets 21, 22 of the pressure plate 3 so that the free movement of the pressure plate 3 is prevented.

Referring now to FIGS. 3 and 4, a second embodiment is disclosed in which the pressure plate 3 is provided with a modification to control the excessive freedom of the pressure plate. This modification comprises a pin 26 projecting from each of two opposed sides of the pressure plate 3. The pins 26 engage loosely in respective vertical slots 27 in enlarged plates 8 at the upper ends of vertical frame members 5 to limit the freedom of the pressure plate to move fore and aft. Fitted on each pin 26, inwardly of the plates 8, is a bent plate 28 to limit the movement of the pressure plate sideways. Although this modification restricts movement of the pressure plate 3 in certain directions, the pressure plate 3 is still able to tilt out of the horizontal position freely.

The embodiment of FIGS. 5 and 6 is similar to that disclosed in FIGS. 3 and 4 except that the mounting of the hydraulic cylinder 17 is different in that the hydraulic cylinder is end mounted, an alternative mounting being shown in FIG. 5*a*. In this third embodiment two vertical members 29 extend upwardly, one from the centre of each horizontal member 6, and the members 29 are connected at their tops by a cross-bar 30.

The hydraulic cylinder 17 is supported between the members 29 adjacent the top thereof by means of a spherical bearing 31 or alternatively gimbals. This top mounting for the cylinder 17 is an alternative to the bottom mounting of the previous two embodiments but serves the same purpose in preventing a sideways bending stress on the piston rod 19 of the hydraulic cylinder 17.

The fourth embodiment of FIGS. 7 and 8 shows apparatus for achieving the same result as the first three embodiments by pulling down the pressure plate 3 rather than pushing it down. In this embodiment the pressure plate 3 is held in an uppermost position (as shown in FIG. 7) by a weight 32 on one end of a wire 33 the other end of which is attached to the centre of the pressure plate 3 at 34; the wire 33 passing over pulleys 35 and 36. On the upper surface of each of two opposed side edges of the pressure plate 3 there is mounted a further pulley 37. A second wire 38, anchored at one end to the base plate 10 at 39, passes over the two pulleys 37 to a ram assembly 40. The ram assembly 40 is vertically mounted adjacent one side frame member 5 and comprises a hydraulic cylinder 41 having a piston rod 42. The other end of the second wire 38 is connected to the free end of the piston rod 42 as shown. In order to move the pressure plate 3 downwardly the ram assembly 40 is actuated so as to retract the piston rod 42 thereby pulling on the wire 38 passing over the two pulleys 37 and connected to the base plate anchorage 39.

In the fourth embodiment the freedom of movement is provided by the connection of the wire 33 to the pressure plate 3 at 34 which forms a flexible coupling. This movement is restrained, as in the second and third embodiments, by means of opposed pins 26 and bent plates 28 which co-operate respectively with the slots 27 and the plates 8 in which the slots 27 are formed.

In use, a load to be compressed is located on the base plate 10 beneath the pressure plate 3. The respective ram assembly is then actuated to cause the pressure plate 3 to descend and compress the load against the base plate 10 to the required degree. The gimbals 18 and 20 or wire 33 permit the pressure plate 3 to vary its attitude to the load as it contacts the latter so that irregularities in the shape of the load can be accommodated. Once the pressure plate 3 has compressed the load to the required degree the pressure plate 3 is retracted away from the load which can then be moved.

The modified arrangements of the latter embodiments provide restraint on the pressure plate 3 but does not affect the capability of the pressure plate 3 to move out of a horizontal attitude in order to accommodate irregularities as discussed above. However, excessive swinging of the pressure plate 3 during compression is prevented.

The press of the present invention is designed particularly to palletise loads on a pallet placed beneath the pressure plate 3 on the base 10. The arrangement allows a pallet to be readily located on and removed from the base plate 10 for example by means of a fork lift truck. In addition, during compression of a load, the load can be strapped to the pallet so that an evenly strapped and consolidated load results. This facility is permitted by slots 23 since, during compression, load strapping can be passed around the load by being passed through the pallet and between adjacent slots 23 on the pressure plate 3.

Various types of load can be compressed so as to remove air trapped in loads, for example, stacks of cardboard blanks for boxes which are preferably strapped whilst under compression.

Although gimbals have been described by way of example in the first three embodiments for allowing freedom of movement of the pressure plate it will be understood that any equivalent means that will allow the pressure plate to conform to the load to be compacted may be used e.g. spherical bearings.

I claim:

1. A press for the compression of a load comprising a frame (1) defining a compression area, a pressure member (3) movable relative to the load for compressing the load located within the compression area, means mounting said pressure member (3) to be able during compression to tilt about a first horizontal axis and to tilt about a second horizontal axis substantially perpendicular to said first horizontal axis so as to adopt different angular positions relative to the load whereby irregularity in the shape of the load may be accommodated, and guide means (26, 27, 28) for guiding the pressure member (3) during said movement, said guide means (26, 27) including, at each of two opposed sides of the pressure member, a projection portion (26) and a portion (27) receiving said projection portion, one of said portions being elongate and provided on the frame (1), and the other of said portions being on the pressure member (3).

2. A press for the compression of a load according to claim 1 characterised in that the portions of the guide means comprise two projection pins (26), projecting one from each of the two opposed sides of the pressure member, which engage loosely in respective slots (27) in guide plates (8) on the frame (1).

3. A press for the compression of a load according to claim 1 or 2 characterised in that the cooperating portions (26, 27) of the guide means restrain lateral movement of the pressure member in a first general direction and rotational movement of the pressure member about the axis of movement of the pressure member, the guide means including stop portions (28) for restraining lateral movement of the pressure member in the other generally transverse direction and rotational movement of the pressure plate about a substantially horizontal axis.

4. A press for the compression of a load according to claim 3 characterised in that the stop portions (28) are provided one on each of the projection portions.

5. A press for the compression of a load comprising a frame defining a compression area, a pressure member movable relative to the load for compressing the load located within the compression area, the pressure member during compression, being able to adopt different angular positions relative to the load so as to accommodate irregularity in the shape of the load, and guide means for guiding the pressure member during said movement characterised in that the guide means comprises two projection pins projecting one from each of two opposed sides of the pressure member, which engage loosely in respective elongate slots in guide plates on the frame and which restrain lateral movement of the pressure member in a first general direction and rotational movement of the pressure member about the axis of movement of the pressure member, and an inwardly curved plate on each of the projection pins which restrain lateral movement of the pressure member in the other generally transverse direction and rotational movement of the pressure plate about a substantially horizontal axis.

* * * * *